United States Patent [19]

Richardson et al.

[11] Patent Number: 4,862,336

[45] Date of Patent: Aug. 29, 1989

[54] DIMORPHIC TRUSS UNIT

[75] Inventors: Brian Richardson, San Jose; John Richardson, Los Gatos, both of Calif.

[73] Assignee: Morpheus Lights, Inc., San Jose, Calif.

[21] Appl. No.: 127,931

[22] Filed: Dec. 2, 1987

[51] Int. Cl.[4] ..... E04F 19/00; E04H 14/00

[52] U.S. Cl. ..... 362/285; 362/147; 362/388; 362/404; 248/317; 52/28; 52/645; 52/646

[58] Field of Search ..... 248/317; 362/147, 285, 362/388, 404; 52/28, 645, 646

[56] References Cited

U.S. PATENT DOCUMENTS

| | | | |
|---|---|---|---|
| 3,495,364 | 2/1970 | De Bella | 52/28 X |
| 4,167,783 | 9/1979 | Mitchell | 362/285 X |
| 4,523,256 | 6/1985 | Small | 362/285 X |

*Primary Examiner*—Allen M. Ostrager
*Attorney, Agent, or Firm*—Rosenblum, Parish & Bacigalupi

[57] ABSTRACT

A truss unit having an elongated frame and rows of lights suspended downwardly from the frame. The lights are mounted on rods for displacement in a sliding motion in a direction transverse to the elongated frame. A first rigid lateral member is pivotally connected to a first side of the frame at a hinge joint, while the second rigid lateral member is pivotally hinged to a second side opposite the first. The first and second lateral members each have a longitudinal extension at least as great as that of the rows of lights. The truss unit has an operation configuration in which the lateral members extend upwardly to display the rows of lights. In the operation configuration the lights are moved to an extreme spaced apart position and the lateral members are locked in place by diagonal braces. Prior to transport, the truss unit may be moved to a transportation configuration with the first and second lateral members extending downwardly to protect the rows of lights. In a transportation configuration the lights are moved in closely spaced relation. A plurality of wheeled legs are removably attached to the frame and the lateral members are selectively locked to the legs to create a packaged transportation configuration.

20 Claims, 3 Drawing Sheets

DIMORPHIC TRUSS UNIT

TECHNICAL FIELD

The present invention relates generally to support structures and particularly to a truss system for supporting a plurality of stage lights.

BACKGROUND ART

It has become increasingly common for entertainers to include a light system as part of the equipment carried from location to location during a concert tour. The light system is used to enhance the performance of an entertainer, with individual lights remotely controlled to pan a stage or to tilt, as well as to change the color and intensity of the beam issuing from the light.

The type of lighting best suited for an entertainer depends upon the style of music of the entertainer. What is considered tasteful and aesthetically pleasing for a concert featuring classical music will differ from that of a concert featuring rock music or jazz music, for example. Individualized lighting systems permit entertainers to create an atmosphere best suited for a style of music and to vary the lighting for particular songs.

The negative aspect of utilizing an individualized lighting system is that the set-up time and takedown time involved in assembly of touring equipment is substantially increased. The electronics and the lens positioning within each stage light requires that the lights be handled carefully. Thus, in transporting lights from one tour stop to a second tour stop, the lights must be packaged so that they are not struck with any significant amount of force. Generally, stage lights are suspended from a number of truss units which are hoisted above a stage. The truss units provide protection if stage lights are transported while still affixed to the truss units, but the protection is limited since the truss unit will not encase the stage lights. Stage lights are normally mounted on a truss unit so that each stage light may be rotated a complete 360°. Any downward extension of a truss unit would, therefore, affect stage lighting. Consequently, the protection offered by the truss unit is limited to a single direction in those systems designed to take advantage of the full 360° of rotation.

FIG. 1 of U. S. Pat. Nos. 4,392,187 to Bornhorst and 4,512,117 to Lange illustrate truss units which support stage lights but which offer only a very limited amount of protection. Stage lights of such systems must be individually removed from the truss units prior to transportation or further protection must be added to the truss unit.

SUMMARY OF THE INVENTION

It is an object of the present invention to provide a truss unit which allows stage lights to direct a light beam about an arc of 360° without beam interference by the truss unit, but which protectively encases the stage lights during transportation.

The above object has been met by a dimorphic truss unit having an operation configuration in which a plurality of stage lights are displayed, and having a transportation configuration in which the stage lights are protectively encased. The stage lights are suspended in one or more rows from a truss frame. The truss frame is an elongated, generally flat structure having opposed first and second sides. A lateral member is attached to each side at a hinge joint. The truss frame, the opposed lateral members and a leg assembly combine to protect the stage lights during transportation.

In an operation configuration, the opposed lateral members extend upwardly from the hinge joints. Diagonal braces are employed to connect the lateral members to the truss frame. The lateral members may then be used as hand rails when the frame is used as a walkway. It is possible to releasably link a number of truss units together if an expansive lighting system is desired.

After completion of a performance, each truss unit is secured into a transportation configuration. The diagonal braces are removed and each lateral member is pivoted at the hinge joint. In a downward reaching position a lateral member protects a side of the rows of lights. The lateral members are each rectangular structures constructed of hollow beams. Prior to lowering of the lateral members, a number of legs are joined to the frame member. The legs extend vertically and include horizontal crossbars which protect the underside of the rows of lights. The lateral members are attached to the legs by release pins to maintain the truss unit in a protective, tightly packaged stage during transportation. Wheels on each leg facilitate moving of the truss units between a motor vehicle and a stage.

One problem encountered in the discovery of such a folding assembly is that lights in adjacent rows of lights of any truss unit must be spaced apart a substantial amount to permit panning or tilting from a gimbal mechanism. One solution to this problem would be to significantly increase the width of the truss unit. The present invention, however, mounts each light on a transverse rod for displacement in a sliding motion. The lights are moved to a central position during transportation and are moved outwardly prior to operation. A T-clamp is utilized to retain a light in the desired position.

An advantage of the present invention is that a lighting system may be changed between a protective transportation configuration and an operation configuration in a very short time by a single technician. Each truss unit provides its own protection during transport and provides a convenient means for suspending the truss unit during a performance. Another advantage is that area which must be protected is reduced by the inclusion of sliding rods which allow the lights to be brought into close relation during transport.

BEST MODE FOR CARRYING OUT THE INVENTION

Figure 1:
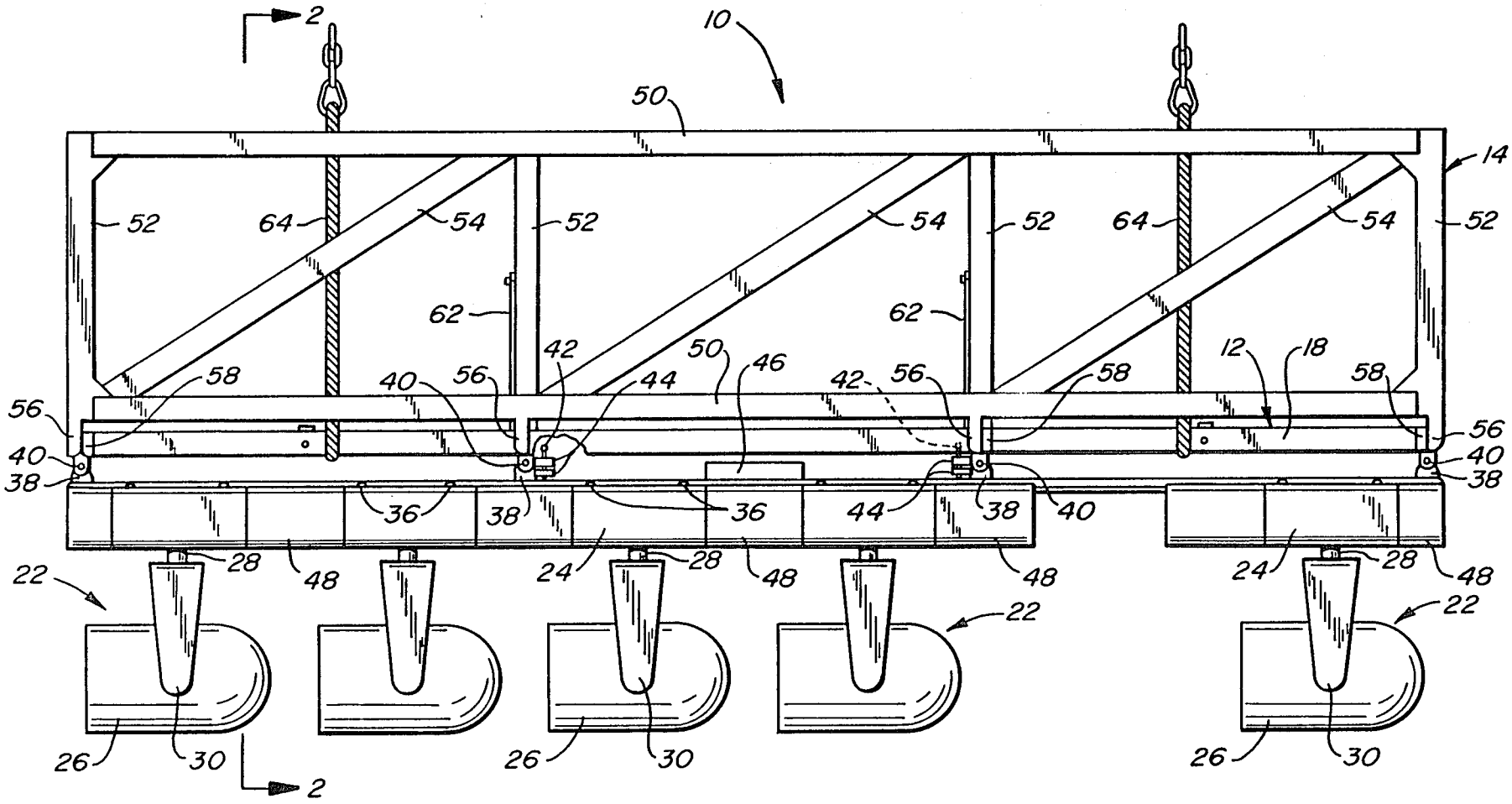
FIG. 1 is a side view of a truss unit in accord with the present invention, shown in an operation configuration.
Figure 2:
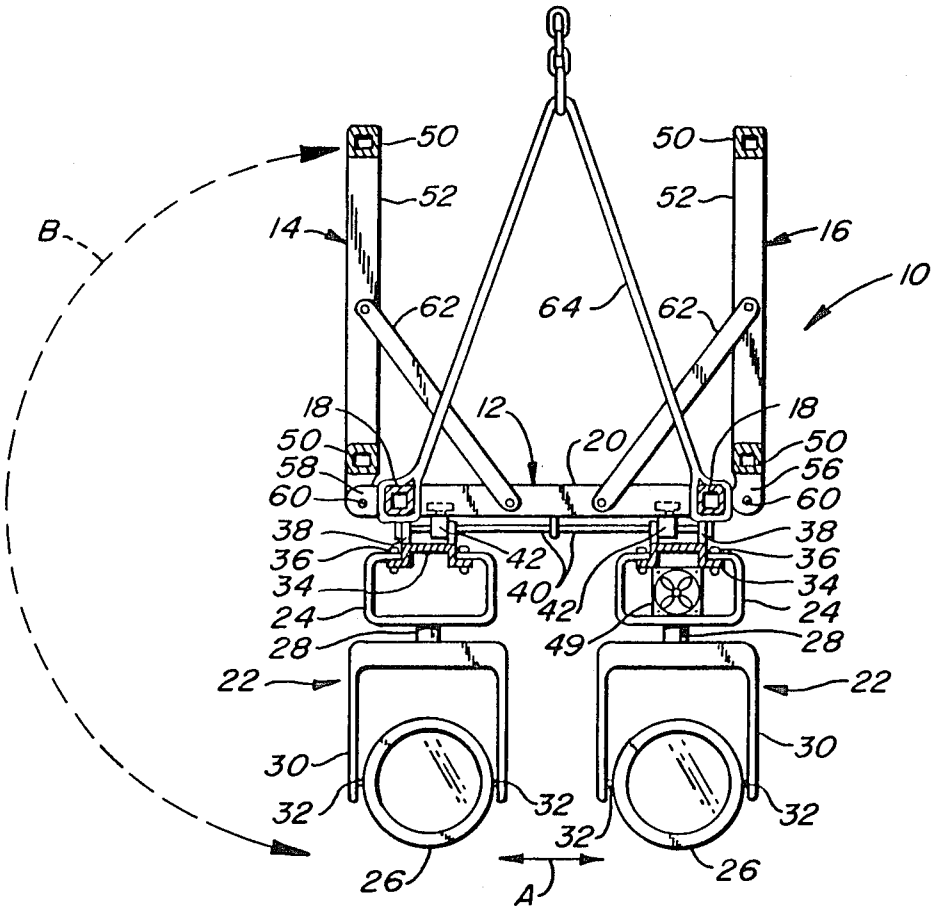
FIG. 2 is a front sectional view of the truss unit taken along side 2—2 of FIG. 1.

With reference to FIGS. 1 and 2, a truss unit 10 is shown in an operation configuration. The truss unit 10 includes a frame 12 and opposed lateral members 14 and 16 pivotally connected to the frame 12. The frame 12 is constructed of a pair of longitudinally extending beams 18 connected together by a plurality of crossbeams 20. The longitudinal beams 18 and crossbeams 20 are made of a material which supports personnel walking upon the frame 12.

Lights 22 are suspended from the frame 12. The lights 22 are arranged in a pair of rows, with lights in adjacent rows being either staggered or in side-by-side relation, as shown in FIGS. 1 and 2. The lights include a control box 24 and a lamp 26. The mechanical and electrical components within the control box 24 have been omitted for the purpose of clarity. The lamp 26 is caused to pan by rotation about an axis defined by shaft 28 which turns a forked lamp retainer 30. Tilting occurs by rotation of the lamp 26 on projections 32 of the forked lamp retainer 30.

The control boxes 24 are attached to a rail 34 and secured in place by retainer pins 36. The rail 34 is affixed to a number of brackets 38 having apertures which receive a slide rod 40 connected to the frame 12. Thus, the rails 34 which support the lights 22 are attached to the frame 12 for displacement in a transverse sliding motion on slide rods 40, as indicated by Arrow A of FIG. 2. During operation; the lights 22 must be sufficiently spaced to permit panning and tilting. The lights may be secured in extreme spaced apart relation on slide rods 40 by tightening of T-clamps 42 which press plates 44 together to grasp the slide rods 40, as shown in FIG. 1.

A power connection device 46 is mounted in the center of the frame 12 for the distribution of power to each light 22. A single power line is laced to the power connection device 46, whereafter each light 22 obtains power by connection to the device 46. Areas along the rail 34 which are not occupied by a control box 24 are covered by a bracket plate 48. Thus, the control boxes and the bracket plates, all of which are open at longitudinal ends, combine to form an air duct along the length of the truss. In FIG. 1 one light has been omitted to illustrate the rail 34, but typically the air duct stretches longitudinally along the entire truss 10. Thus, a single fan 49 may be mounted at an end of the truss 10 to provide air circulation to the components on the control boxes 24, rather than utilizing a separate fan for each control box.

The lateral members 14 and 16 each primarily comprise hollow beams which define elongated sides 50 joined together by perpendicular crossbeams 52 and diagonal crossbeams 54. The lateral members 14 and 16 have ears 56 which are in frictional contact with ears 58 projecting from the frame 12. The ears 56 and 58 of the lateral members and the frame each have an aperture which receives a hinge pin 60 to define a hinge joint.

The hinging connection of the lateral members 14 and 16 to the frame 12 allows the lateral members to pivot, as indicated by Arrow B in FIG. 2. The lateral members 14 and 16 are locked in the U-shaped operation configuration by diagonal braces 62. Both the cross beams 20 of the frame and the lower ends of the diagonal braces 62 have apertures which, when aligned, position the lateral members 14 and 16 at a right angle to the frame 12. Pins, not shown, are inserted through the apertures to maintain the truss unit 10 in an operation configuration. The truss unit 10 may then be raised to a desired height by attachment of a chain hoisted cable 64 to the longitudinal beams 18 of the frame. Alternatively, the truss unit 10 may be attached to a ladder lift assembly that is known in the trade to raise the truss unit to various heights.

Figure 4:
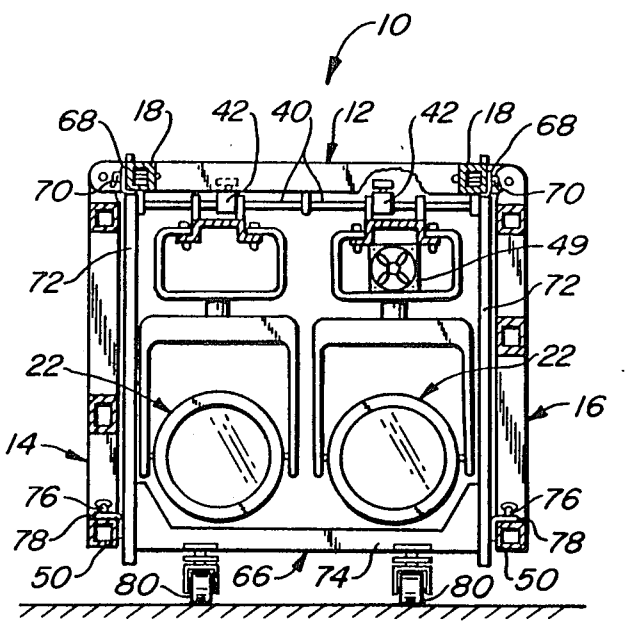
FIG. 4 is a front sectional view of the truss unit taken along lines 4—4 of FIG. 3.
Figure 3:
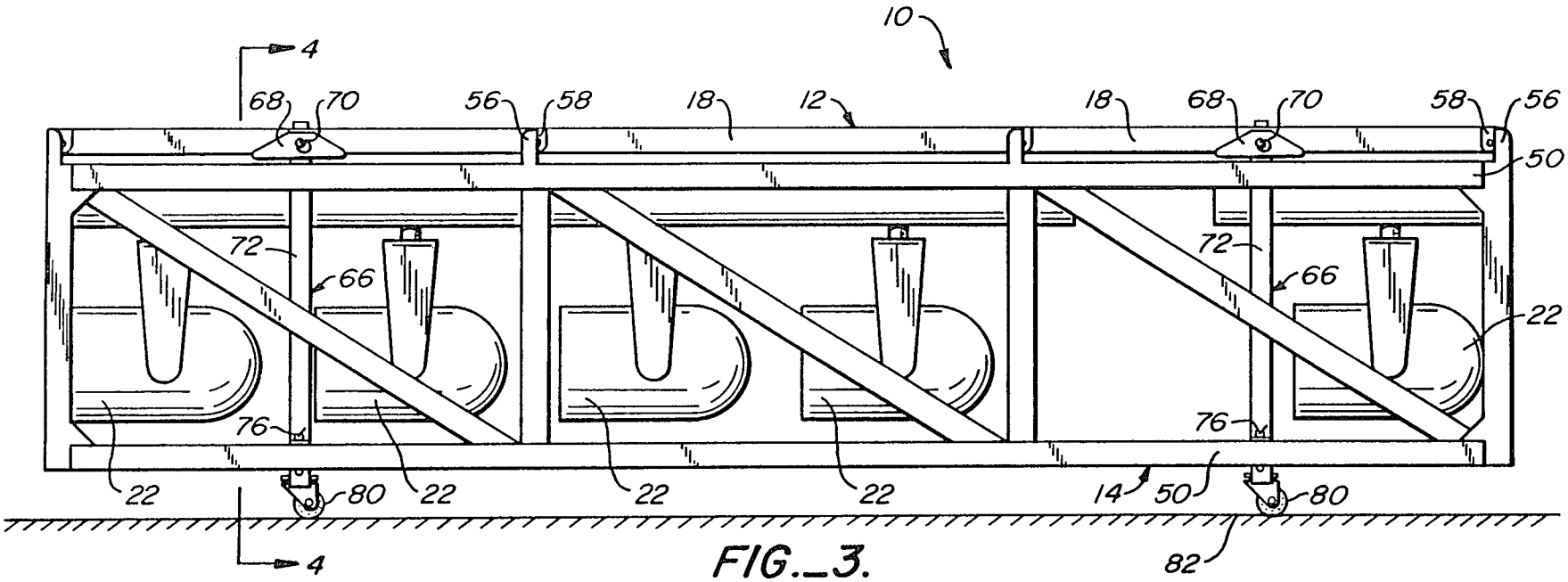
FIG. 3 is a side view of the truss unit of FIG. 1 shown in a transportation configuration.

The truss unit 10 may be utilized to illuminate a musical concert or a theatrical performance. After such use, the truss unit 10 is folded into the transportation configuration shown in FIGS. 3 and 4. Prior to the lowering of the lateral members 14 and 16, legs 66 are attached to the frame 12. Each leg 66 includes opposed horizontally-elongated upper brackets 68 which frictionally contact the outward surface of each longitudinal beam 18 of the frame. A ringed pin 70 may be pushed through apertures in an upper bracket 68 and a beam 18 to secure the leg 66 to the frame 12. The penetration of the ringed pin 70 is best seen in FIG. 4. The ring portion of the ringed pin facilitates grasping the pin portion during removal.

The truss unit 10 rests upon the vertical supports 72 of the leg. A horizontal crosspiece 74 bridges the vertical supports 72 for stability and to protect the lights 22 which must be brought in closely spaced relation to accommodate insertion of the legs 66. The lights are displaced by release of the tension created by the T-clamps 42. Release of the tension permits the lights to be shifted along slide rods 40, after which the T-clamps 42 are again tightened.

With the lights 22 in closely spaced relation and with the legs 66 fastened to the frame 12, the lateral members 14 and 16 are lowered to form an inverted U-shaped transportation configuration with the frame 12. Another set of ringed pins 76 are used to maintain the position of the lateral members. The ringed pins 76 pass through aligned holes in right angle brackets 78 of the legs 66 and in the elongated side beams 50 of the lateral members 14 and 16.

In the transportation configuration, the lights 22 are protected from above by the frame 12, from below by the horizontal crosspieces 74 of the legs 66, and from the sides by the lateral members 14 and 16. Thus, the truss unit may be transported without concern that a force will strike the lights 22 to jar the lens arrangement or the electrical equipment within the lights. Caster wheels 80 are mounted to the legs 66 for ease of truss unit movement along a surface 82.

A plurality of truss units 10 may be mounted end-to-end to form a lighting system. The distant ends of each truss unit include bolt holes which receive bolts sufficiently rigid to hold the truss units together. The truss units are then separated after a performance and stacked. In a stacked arrangement, a truss unit that is positioned above another truss unit will be supported by contact of the legs 66 of the upper unit against the longitudinal frame beams 18 of the lower unit. The caster wheels 80 of the upper unit will not be in contact with the lower unit.

In operation, a truss unit 10 may be moved from the transportation configuration of FIG. 4 to the operation configuration of FIG. 2 by a single technician. Firstly, the ringed pins 76 which secure the lateral members 14 and 16 to the frame 12 are removed. The lateral members may then be pivoted to an upwardly extending position. With the lateral members 14 and 16 at a right angle to the frame 12, the apertures in the lower ends of the diagonal braces 62 will be aligned with apertures in the cross beam 20 of the frame. Pins projected through the aligned holes will lock the truss unit in a U-shaped operation mode.

A chain hoisted cable 64 raises the truss unit 10 slightly above the ground surface. In this position, the ringed pins 70 which hold the legs 66 to the frame 12 are extracted and the legs 66 are removed from the truss unit. The T-clamps 42 must be relaxed to allow outward movement of the lights 22. The lights are slid to the outward extreme position along slide rod 40 so that lights in adjacent rows do not interfere with one another during a panning or tilting maneuver of the lights. The T-clamps 42 are once again tensioned.

Finally, the truss unit 10 is raised to the desired height for illumination of a performance. Afterward, the truss unit may be returned to a transportation configuration by reversing the above-described procedure.

What is claimed:

1. A truss unit reconfigurable between a transportation state and an operation state, comprising:

an elongated frame having opposed first and second longitudinally extending sides, at least one row of lights suspended downwardly along the length of said frame, a first rigid lateral member, a second rigid lateral member, first hinge means interconnecting said first lateral member to said first side and second hinge means interconnecting said second lateral member to said second side of said frame for selectively pivoting said first and second lateral members between a downwardly extending transportation configuration and an upwardly extending operation configuration, and locking means for fastening said first and second lateral members relative to said frame to secure said lateral members in an upwardly extending operation configuration.

2. The truss unit of claim 1 comprising two rows of lights.

3. The truss unit of claim 2 comprising a plurality of rods disposed transverse to the length of said elongated frame, wherein each row of lights is mounted for sliding displacement along said rods.

4. The truss unit of claim 1 comprising a plurality of legs removably attachable and selectively lockable to said frame to configure said truss unit in said transportation state.

5. The truss unit of claim 4 wherein each said leg has a plurality of wheels distal said frame.

6. The truss unit of claim 1 wherein said locking means comprises a plurality of braces extending diagonally between said lateral members and said frame.

7. The truss unit of claim 1 wherein said first and second lateral members each have a vertical dimension greater than the vertical dimension of said lights.

8. The truss unit of claim 1 wherein each light is rotatable relative to said frame, said rotation of a light governed by a control box associated with an individual light in a row of lights, each control box having opposed open ends in air flow communication with adjacent control boxes in said row of lights, said truss unit further comprising an air recirculation means at one end of a row of lights to circulate air through said open ends of the control boxes.

9. A dimorphic truss unit comprising:

an elongated frame having horizontal first and second sides parallel-spaced around the longitudinal axis of said frame, a plurality of lights suspended from said frame in at least two rows of lights parallel to said axis, each said row of lights being mounted for displacement in a direction perpendicular to said axis, first hinge means connected to said first side and second hinge means connected to said second side, and a first quadrilateral member attached to said first hinge means to pivot relative to said frame and a second quadrilateral member attached to pivot said second hinge means relative to said frame, said quadrilateral members having a first upwardly extending operation configuration which exposes said lights and having a second downwardly depending transportation configuration which protects said lights in the space between said quadrilateral members.

10. The truss unit of claim 9 comprising a plurality of rods disposed perpendicularly to said frame axis, upon which said rows of lights are slidably mounted to permit axially inward motion of said rows of lights into a transportation position and axially outward motion into an operation position.

11. The truss unit of claim 10 comprising clamping means for securing said rows of lights to said rods in desired positions relative to said axis.

12. The truss unit of claim 9 wherein said quadrilateral members are securable in said operation configuration by a plurality of braces attachable diagonally between said frame and respective quadrilateral members.

13. The truss unit of claim 9 comprising a plurality of legs removably attachable to said frame perpendicular to said axis, each leg having an end with wheels distal said frame.

14. The truss unit of claim 13 wherein each said quadrilateral member is selectively attachable to said legs to secure said quadrilateral member in a transportation position.

15. The truss unit of claim 9 wherein each light is rotatable relative to said frame, said rotation of a light governed by a control box associated with an individual light in a row of lights, each control box having opposed open ends in air flow communication with adjacent control boxes in said row of lights, said truss unit further comprising an air recirculation means at one end of a row of lights to circulate air through said open ends of the control boxes.

16. A truss unit having an upright U-shaped operation configuration and an inverted U-shaped transportation configuration, comprising:

an elongated frame having first and second sides parallel spaced around a longitudinal axis of said frame, a plurality of lights disposed in at least one row suspended from said frame, a first lateral member hinged to said first side for pivotal motion relative to said frame, a second lateral member hinged to said second side for pivotal motion relative to said frame, said lateral members each having a length at least as great as the length of said rows of lights, locking means for fastening said first and second lateral members in an upwardly reaching operation position, and leg means for supporting said frame, said leg means having a height greater than the height of said lights and having means for securing said first and second lateral members into downward positions for transportation.

17. The truss unit of claim 16 comprising rods perpendicular to said axis from which said lights are slidably suspended.

18. The truss unit of claim 16 wherein said locking means comprises a plurality of diagonal braces connecting said first and second lateral members to said frame.

19. The truss unit of claim 16 wherein each said leg means includes wheels.

20. The truss unit of claim 16 wherein each light is rotatable relative to said frame, said rotation of a light governed by a control box associated with an individual light in a row of lights, each control box having opposed open ends in air flow communication with adjacent control boxes in said row of lights, said truss unit further comprising an air recirculation means at one end of a row of lights to circulate air through said open ends of the control boxes.

* * * * *